US007600473B2

(12) United States Patent
Sheppard, Jr.

(10) Patent No.: US 7,600,473 B2
(45) Date of Patent: Oct. 13, 2009

(54) METHOD OF MAKING JACQUARD WOVEN TEXTILE WITH GRAPHIC IMPRESSION

(75) Inventor: James M. Sheppard, Jr., 953 Eagle Rd., Weddington, NC (US) 28173

(73) Assignee: James M. Sheppard, Jr., Mooresville, NC (US)

( * ) Notice: Subject to any disclaimer, the term of this patent is extended or adjusted under 35 U.S.C. 154(b) by 1197 days.

(21) Appl. No.: 10/314,794

(22) Filed: Feb. 19, 2003

(65) Prior Publication Data

US 2003/0131901 A1 Jul. 17, 2003

Related U.S. Application Data

(62) Division of application No. 09/747,529, filed on Dec. 22, 2000.

(51) Int. Cl.
*B41F 33/00* (2006.01)

(52) U.S. Cl. ..... 101/483; 139/383 R

(58) Field of Classification Search ..... 101/129, 101/483; 139/383 R, 398, 403, 405
See application file for complete search history.

(56) References Cited

U.S. PATENT DOCUMENTS 1,925,459 A * 9/1933 Pinkney et. al. ..... 139/396
2,163,769 A * 6/1939 Jean Terrasse ..... 139/413
3,669,818 A * 6/1972 Stark ..... 428/88
4,769,879 A * 9/1988 Otto ..... 26/25
5,368,611 A 11/1994 Owenby et al.
5,655,574 A * 8/1997 Warnecke ..... 139/383 R
5,685,223 A 11/1997 Vermuelen et al.
6,105,624 A 8/2000 Wildeman et al.

FOREIGN PATENT DOCUMENTS

JP 09310468 A * 12/1997

* cited by examiner

*Primary Examiner*—Ren Yan
(74) *Attorney, Agent, or Firm*—Clements Bernard PLLC; Gregory N. Clements

(57) ABSTRACT

The present invention relates to a method of making the textile article. The textile article is a two-sided Jacquard woven textile with a graphic impression on at least one side thereof. In one embodiment, the front side of the textile has a dark color border and a light color area within said border. The light color area is the area receiving the graphic impression. It is sometimes advantageous to reverse the textile. Therefore, in another embodiment the front side has a light color border with a dark central area, and the dark central area will receive the graphic impression. The graphic impression may be applied by screen printing, image dyeing, digital imaging, or heat transfer (heat applied graphics). The method of making the article comprises the steps of providing a two-sided Jacquard woven textile and then transferring the impression onto the textile, preferably in the light color central area, but the reverse side of the textile could be employed and the impression could be on the dark central area. The textile may be a golf or sports towel, hand, bath, or wash towel, beach towel and the like.

10 Claims, 5 Drawing Sheets

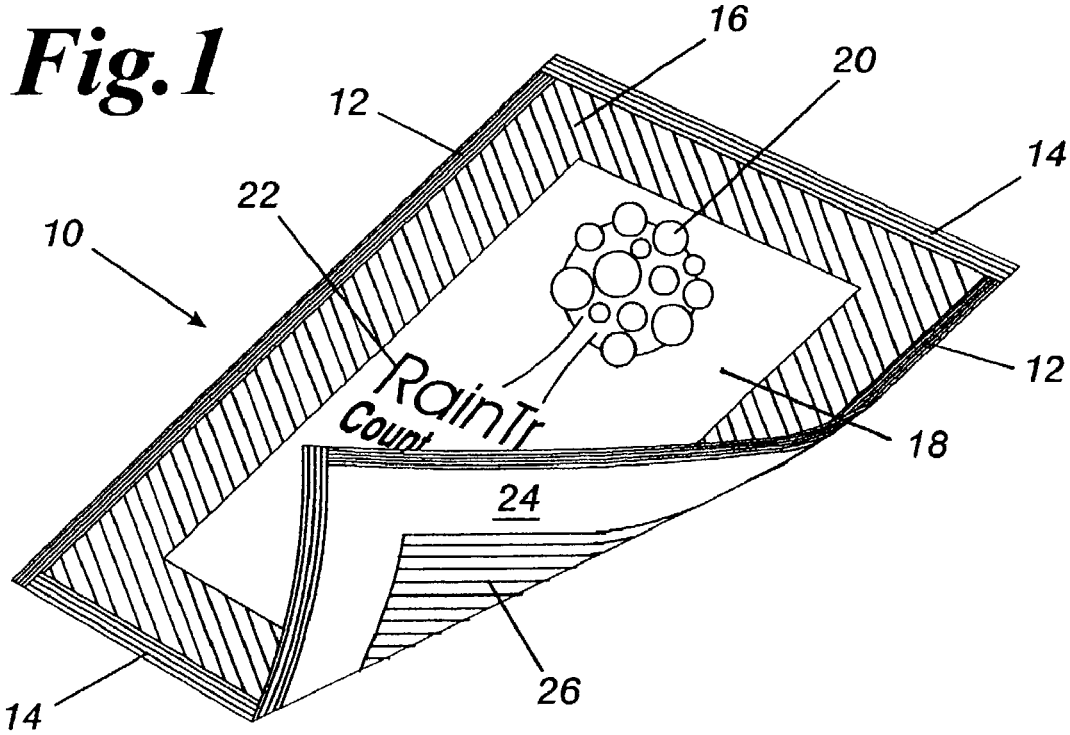
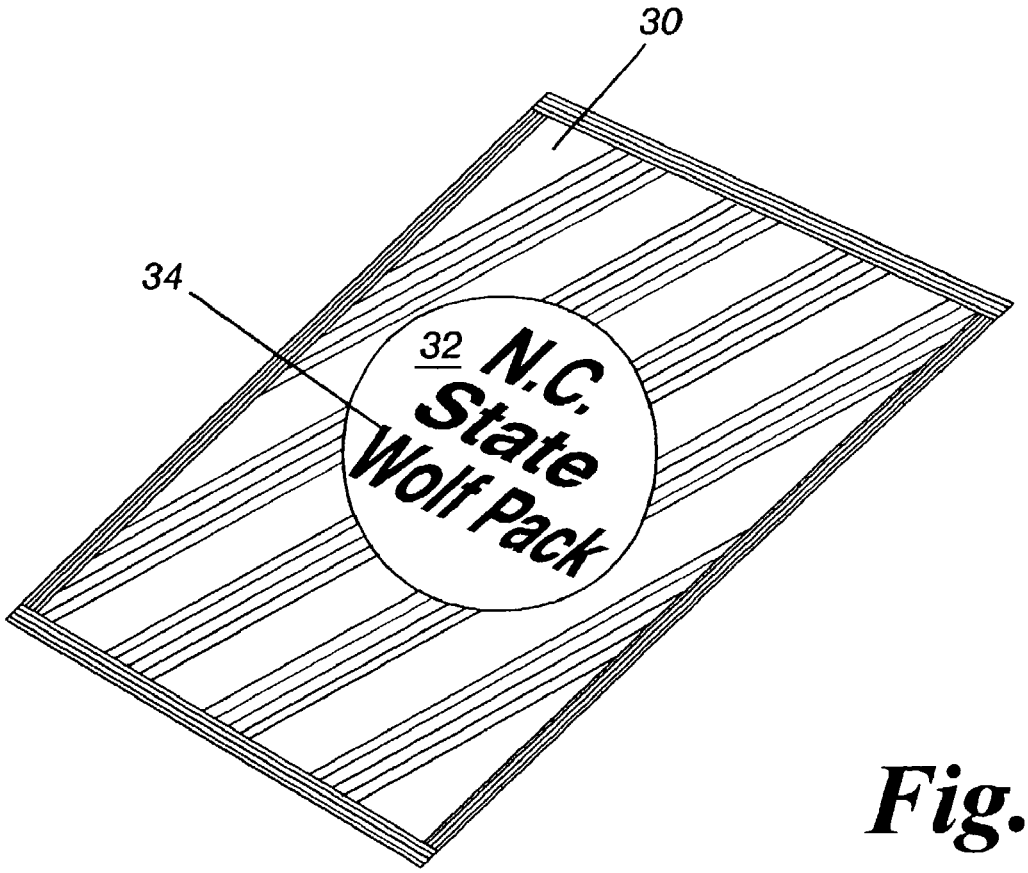
Fig.2

METHOD OF MAKING JACQUARD WOVEN TEXTILE WITH GRAPHIC IMPRESSION

CROSS REFERENCE TO RELATED APPLICATION

This application is a division of U.S. Ser. No. 09/747,529 filed Dec. 22, 2000. Additionally, this application claims the benefit of U.S. Provisional Application No. 60/173,275, filed Dec. 28, 1999.

BACKGROUND OF THE INVENTION

1) Field of the Invention

The present invention relates to a method of making a textile article. The textile article is a two-sided Jacquard woven textile with a graphic impression on at least one side thereof. In one embodiment, the front side of the textile has a dark color border and a light color area within said border. The light color area is the area receiving the graphic impression. It is sometimes advantageous to reverse the textile. Therefore, in another embodiment the front side has a light color border with a dark central area, and the dark central area will receive the graphic impression. The graphic impression may be applied by screen printing, image dyeing, digital imaging, or heat transfer (heat applied graphics). The method of making the article comprises the steps of weaving a two-sided Jacquard woven textile and then transferring the impression onto the textile, preferably in the light color central area, but the reverse side of the textile could be employed and the impression could be on the dark central area. The textile is a towel.

2) Prior Art

It is well known to those skilled in the art that textile terry cloth items can be printed thereon, for example, for towels such as small holiday towels for the kitchen or bath. In particular, terry cloth, conventionally made of cotton or cotton-blend fiber, is made on a dobby loom and the loops on each side of the textile are uncut. Printing various designs on such a towel is well known to those skilled in the art. Other terry cloth items have embroidered designs, names, or messages thereon which is a more expensive process, but on the other hand, they have a neater and more appealing appearance.

Jacquard weaving is a well known weaving process that can be employed for creating thick, luxurious pile textile items capable of having a velour or looped terry nap and employs two different colors in the linear band of the warp filaments when fabricating a textile article. Jacquard weaving is very expensive and the limitation of two colors in the warp filaments limits the utility for these types of textile articles. The textile industry is primarily located in cheap labor markets. Nevertheless, Jacquard woven articles remain comparatively high in price. The high price coupled with the limitations in the number of colors that can be patterned into a Jacquard woven textile, causes the industry to use terry cloth made on looms, and printing can be done with different colors to create an infinite number of patterns, colors, and messages, and the cost is comparatively very inexpensive, especially in large quantities. Moreover, a Jacquard woven textile cannot be employed with two independent and distinct designs on each side of the textile article because the color on one side alternates with the color on the other side of the textile. For example, if one side of the towel has a dark border with a light color central portion, the other side of the towel has a dark central portion with a light color border.

U.S. Pat. No. 5,368,611 to Owenby et al. discloses a printed woven blanket, which is printed on one side only but has the appearance of having been printed on both sides. Specifically, cationic dye is applied to one side of the blanket with sufficient force that the dye penetrates through to the nap of the other side of the blanket. This reference also compares the cost of a woven textile having print thereon with an equivalent textile article woven from a Jacquard weaving. The printing is preferably accomplished by applying the dye through a roller that places downward pressure on the dye forcing the dye into the blanket yarn. The downward pressure is caused by an electro-magnet that interacts with the roller. The downward force applied by the magnet is made variable by employing a variable resister so that the amount of pressure from the roller is controlled, thus the printed color intensity is controllable.

U.S. Pat. No. 5,685,223 to Vermuelen et al. discloses a simulated Jacquard woven fabric in which the fabric is printed with especially engraved screens for each color of the design.

U.S. Pat. No. 6,105,624 to Wildeman et al. discloses a Jacquard woven fabric in which a printed pattern is printed on the warp yams so that as the Jacquard weaving process proceeds, the design on the warp yarn becomes reality in the Jacquard woven textile. By using the design on the warp yarn, the operators of the Jacquard loom can make certain that the pattern meant to be created in the Jacquard woven textile will be made.

Jacquard weaving is expensive and because of the limitations that it imposes upon the textile article produced, namely, the fact that the process creates the reverse pattern on the opposite side of the textile from the pattern desired on the primary side, it is rarely employed in the art. Those skilled in the art have recognized that they can simulate a Jacquard woven textile look by fully printing a color pattern on the front side of the textile. However, the other side of the textile remains without graphics, showing only the original color of the towel. One can employ as many colors as desired to print upon the terry cloth article, all of which is cheaper than producing even a two color Jacquard woven article. The disadvantages of the terry cloth Jacquard simulation is that the reverse side is limited to only the original color of the textile.

With the expense of a Jacquard woven textile coupled with the limitations in designing a pattern on such a textile, there is no reason one skilled in the art would ever print or place a graphic impression on a Jacquard woven article. In fact, this is borne out by the complete lack of prior art disclosure of such a textile article.

There remains a need to produce a Jacquard woven article in multiple colors greater than present limitations on the Jacquard loom. Moreover, there remains a need to provide an upscale towel that is more luxurious, and can be produced in large or small quantities.

SUMMARY OF THE INVENTION

In the industry, graphic impressions on a Jacquard textile would be considered a step backward, thereby ruining a quality product. The present invention has merged the benefits of the Jacquard woven article with graphic impressions and has enjoyed the benefits of each, while avoiding undesirable features of the Jacquard weaving process and the simulated Jacquard look of graphic impression.

The broadest sense of the present invention is a method for making a textile article comprising providing a two-sided Jacquard woven textile and transferring a graphic impression on said textile. The step of transferring can be screen printing, digital imaging, image dyeing or heat transferring.

The first embodiment has a dark color border with a light color central section. The first embodiment is the most preferred embodiment. The second embodiment has a light color border with a dark color central area.

BRIEF DESCRIPTION OF THE DRAWINGS

The Figures of the Drawing set forth herein are for illustrating the invention and to enable3 those skilled in the art to better understand the invention. It is not intended to limit the invention in any manner inconsistent with the claims.

FIG. 1 shows a perspective view of a two-sided woven textile article with one corner turned over to reveal the reverse side thereof.

FIG. 2 is a perspective view of another woven textile article in which the border is irregular in shape and has a stripe pattern thereon with the central area being circular in shape.

DESCRIPTION OF THE PREFERRED EMBODIMENTS

Figure 3:
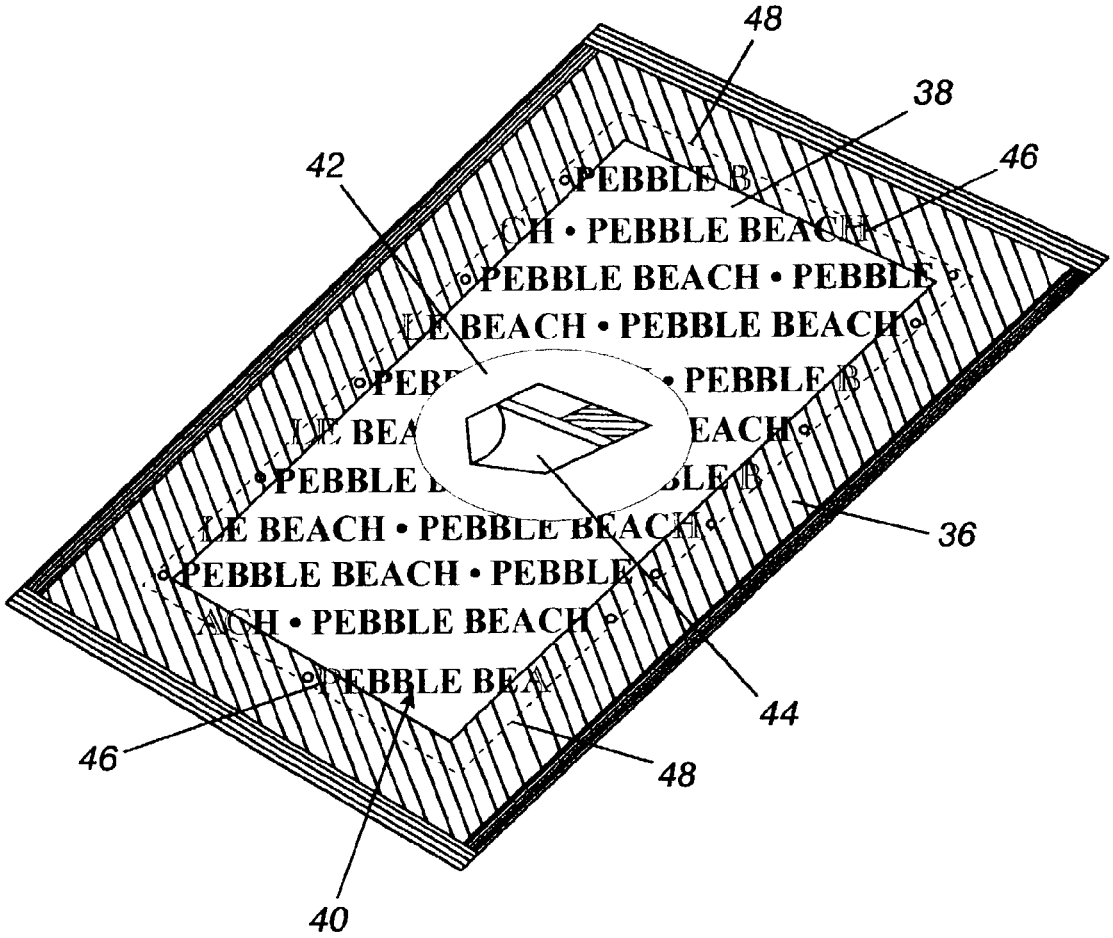
FIG. 3 is a perspective view of a woven textile that illustrates the overlapping printing of the graphic onto the border.

A two-sided, Jacquard woven textile article is created (woven) on a conventional Jacquard loom well known to those skilled in the art, using light and dark color fibers. The final article desired could be a planar article trapezoidal in shape, rectangular in shape, square in shape, oval in shape, round in shape, etc. The textile typically has two selvage edge portions and two dobby hem portions surrounding the woven portion. The edge and hem portions are generally the warp and weft yams tightly woven to prevent the textile from unraveling. Thus the edge and hem portions may be solid in color, or a mixture of colors such as a checkerboard pattern.

The Jacquard textile article of the present invention has a border within the edge and hem portions. The border may preferably be a solid color, or a pattern of any width, including a variable width (wherein it is wider on one side of the article than it is on the remaining sides, for example). The border may be the exact shape of the textile article, such that it is rectangular in shape, circular in shape, oval in shape, square in shape, or shaped differently than the textile shape such that it is irregular. Typical dark colors for the border of embodiment one may be green, blue, maroon, brown or black, but the invention is not limited to these. Typical light colors for the border for embodiment two may be white, off-white, beige, khaki, light blue, light green, light gray, or light red, but the invention is not limited to these.

The border may be solid as has been discussed or a pattern. For example, the pattern may be stripes, dots, a name or a silhouette of a sports player, such as a volleyball player, golfer, or bowler; or animal shapes, corporate logos; or university mascots, or any pleasing pattern. The border could also be solid in color with a pattern thereon, such as for example, a dark border with silhouettes of a sports player, stripes, dots, or words such as the name of a resort, in a contrasting color yarn. On the opposite side of the article, everything would be reversed such that the border would be the contrast color and the stripe, dots, or name would appear dark on the border. It is also within the scope of the present invention to screen print, image dye or heat transfer a pattern of one of the shapes previously mentioned as a repeating pattern (or a non-repeating pattern) on and around the border. In such a case, the pattern would generally be a contrasting color. When the border is screen printed, image dyed or heat transferred with a pattern, the pattern appears on that side only.

Centrally located on the textile article of the present invention, within the border, is an area of light color on the front side, and the same area on the reverse side would be dark in color, that is, the same color as the dark color border on the front side. In other words, the preferred embodiment of the present invention is to have a Jacquard woven article in which the front side has a dark border with a central light color area while the reverse side of the article would have a light color border with a central dark color area. More specifically, if a navy blue border with a vanilla color central area exists on the front side, the rear side would have a vanilla color border with a navy color central area. This is a limitation of the Jacquard weaving process. However, this limitation has some advantages as set forth later.

While the central area may be any shape, such as a rectangular shape, circular shape, oval shape, square shape, or irregular shape, its exterior boundary takes the shape of the border itself. However, if the border appears on a rectangular article, for example, and it is desired that the central area be oval shaped, the boundary between the central area and the border will, of course, be oval shaped. That is, the outside boundary of the border conform to the general overall shape of the textile article, while the inner boundary of the border adjacent to the central area is oval shaped. Typical colors for the central area may be white, off-white, beige, khaki, light blue, light green, light gray, or light red, but the invention is not limited to these. Typical dark colors for the central area may be green, blue, maroon, brown or black, but the invention is not limited to these.

The first embodiment has a dark color border with a light color central section. The first embodiment is the most preferred embodiment. With the first embodiment, you can: 1) butt/tight register the graphic to close tolerances to fill the central area, 2) apply the graphic impression anywhere in the central area without touching or overlapping the border, or 3) you can overprint/overlap the graphic so that it extends beyond the boundaries of the central area. The second embodiment has a light color border with a dark color central area. For printing the graphic with the second embodiment, you can only butt/tight register the graphic because overprinting onto the light color border is easily noticed.

The graphic impression may be applied by screen printing, image dyeing, digital imaging (printing with black, cyan-blue, yellow and magenta-red dyes or pigments), or heat transfer (heat applied graphics). Image dyeing utilizes the basic screen printing technique. It is the technology created by Devant LDT. to emphasize the different and unique additives, modifications, and equipment that Devant uses during the screen printing process. It yields a soft, flexible, absorbent impression on the textile article. The graphic impression is generally transferred i.e. screen printed, imaged dyed, digital printed or heat transferred onto the central area. Placing the graphic impression in the center area of the preferred embodiment (dark border with light central area) provides advantages produced by the Jacquard woven process, namely, that on the front side of the Jacquard woven article, a light color central area will appear, and on the reverse side of a Jacquard woven textile, the opposite color pattern would appear, that is, the central area would be dark in color with a light color border. This permits transferring the graphic impression on the front side of the preferred embodiment in the light color central area to be as intense as is desired and in as many colors as is desired and should the printing pigments, inks, dyes, etc., bleed through to the reverse or back side of the textile article, the dark color would mask the bleed through such that it is not seen. If both sides of the textile article are screen printed, image dyed, digital imaging, or heat transferred one must be careful to prevent the dye, pigment, or paint employed on the back side of the textile article from bleeding through to the light color front side. With this in mind, it is often not desirable to print on the reverse side, or to only print in such a manner that the dye is not seen on the front side i.e. transfer the graphic on the reverse side only where the front side has a dark color graphic.

As shown in FIG. 1, reference numeral 10 indicates a Jacquard woven article rectangularly shaped having selvage edge portions 12 and dobby end hems 14. The border 16 interiorly positioned from the edge of the textile article 10 is preferably a dark color on the front side (the side having the graphic impression thereon), and the border 24 is light color on the reverse side. The central area 18 shown on the front side of the textile article is light in color, (the same light color as the reverse side border) while on the central area 26 on the backside is dark in color (the same dark color as border 16 on the front side). Shown on the front side in the central area 18 is the graphic impression illustrating a tree 20 with the words 22 "RAINTREE Country Club" (only a portion of the words are shown). The graphic impressions 20 and 22 do not show up on the reverse side of the Jacquard woven textile article 10 because the dark color of the central area hides any potential bleed through of the dye or pigment.

As shown in FIG. 2, the border is striped 30 and irregular in shape. The central area 32 is circular and has the graphic impression 34 stating "NC State Wolfpack". Although not shown, the border on the reverse side would also be striped but the color of the strips would be the opposite of that on the front side. For example, if the border on the front side has a background color of black with red stripes, then the border on the backside has a red background color with black strips.

The Jacquard textile shown in FIG. 3 has a border 36 having a dark color. The central area 38 is a light color and has several graphics shown thereon. The first graphic 40 is the words "Pebble Beach" running at an angle to the edge portions and hems. The entire graphic is overlapped onto the border 36, showing the overlapping portion 46 bound, for illustration purposes only, by the dotted lines 48. Because the first graphic 40 is the same color as the border 36, the overlapping portion 46 cannot be seen. Actually the overlapping portion is never clearly visible as long as a dark color is employed for the border 36. Other colors may be overprinted that are lighter than the border color, thus allowing the border color to dominate. Within the first graphic 40 is a second central area 42 having a second graphic 44. The second graphic 44 may be multicolored. This graphic within a graphic cannot be woven into a Jacquard textile. The only way for such a design to appear on a Jacquard woven textile article, is by the method of the present invention.

Figure 4:
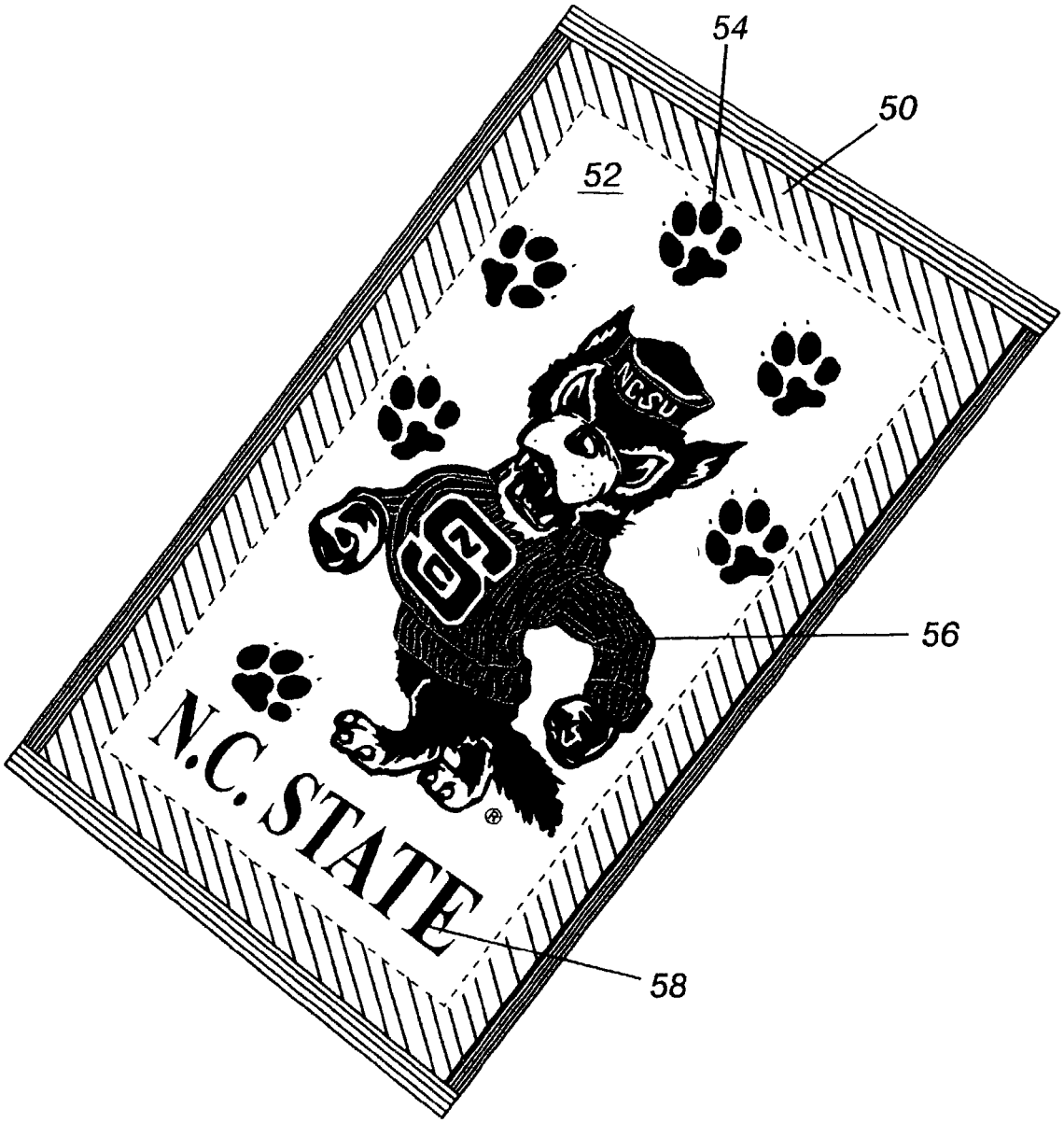
FIG. 4 is a perspective view of another woven textile showing North Carolina State University, including the mascot "Woofie" with wolf tracks shown in the central area.

FIG. 4 shows how words 58, animal paw prints 54, and a university mascot 56 can all be employed within the central area 52 that is within the border 50. Depending on the colors needed for such an elaborate design, this textile cannot be made except by the present invention.

Figure 5:
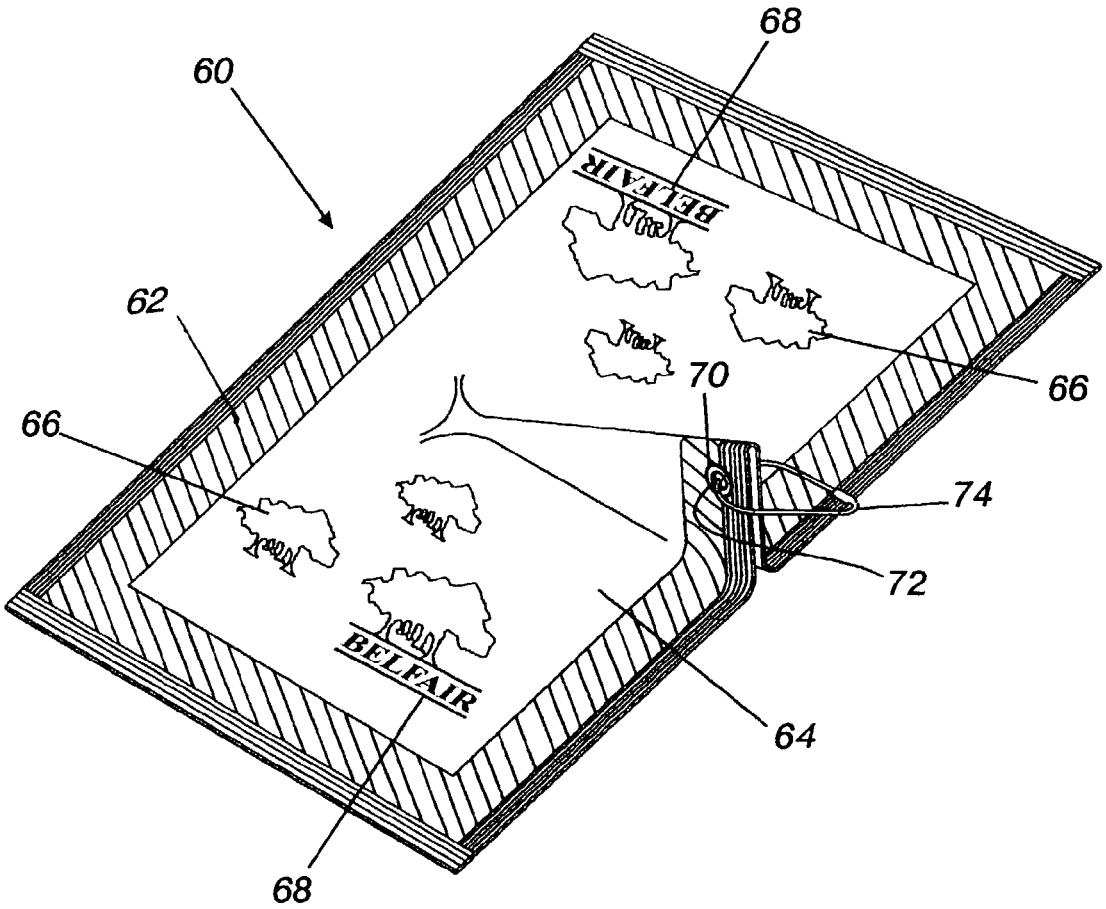
FIG. 5 is a perspective view of a textile article having the graphic illustrated such that when the textile is folded; the graphic is right side up.

FIG. 5 illustrates a textile article 60 having a border 62 with a central area 64. Within the central area 64 are two sets of graphics consisting of trees 66 and words 68. However one set of graphics is upside down with respect to the other set. This permits the article 60 to be folded in half and remain readable from the front face of both halves. A grommet 70 extends through both halves of the article near the fold line (not numbered), thus securing the article halves very tightly around the grommet. The grommet 70 has a hole 72 through which extends a clip-type hanger 74. The hanger 74 is designed to be fastened to a golf bag, for example.

Figure 6:
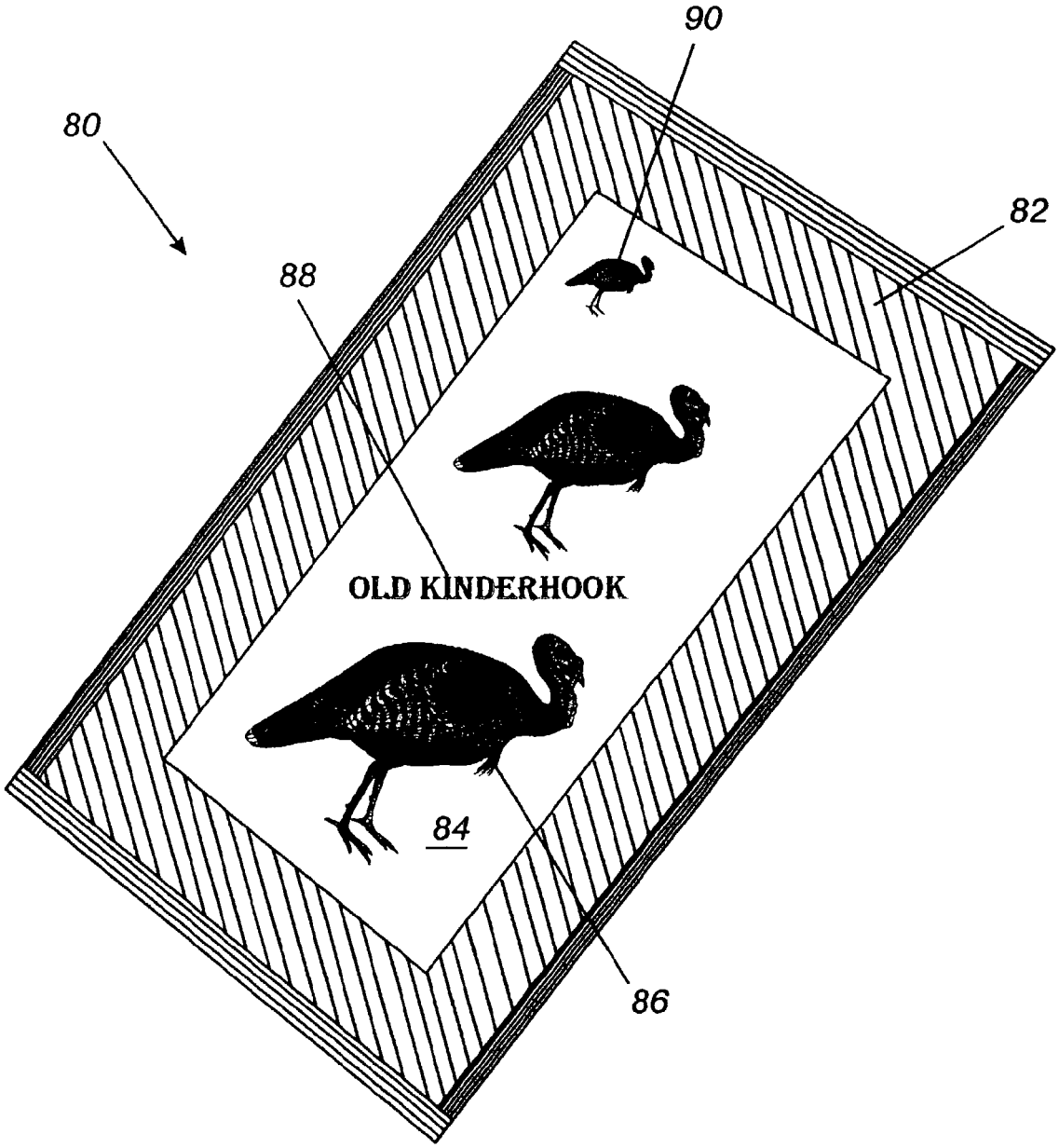
FIG. 6 is another perspective view of a woven textile having in the central area a graphic according to the present invention as well as an embroidered graphic.

FIG. 6 demonstrates the versatility of the present invention. The textile article 80 has a border 82 and a central area 84. Within the central area are 2 animal graphics 86, one centrally located and the other overprinted onto the border, words 88 and an embroidered design 90. This article 80 is for the up-scale market having the multicolor potential for the graphics of the present invention and in addition an embroidered design.

The Jacquard woven textile article can be a towel such as a bath towel, beach towel, kitchen towel, or sports towel. If it is a sports towel, it may be utilized for golf, tennis, bowling, fishing, aerobics fitness, handball, racket ball, baseball, basketball, soccer, football or any other sport.

In order to make the Jacquard woven textile article feel more luxurious, the loops on the front side of the towel are sheared to the same pile height and bloomed to give the towel a more velour feel and appearance. Blooming unravels the yarn slight to give it a bushy or fuzzed-up appearance. The blooming can be accomplished by chemical treatment, heat treatment, or mechanical treatment as is well known in the art. When shearing the loops, the pile on the front side of the textile article is anywhere from 5% to 25% shorter in height. The loops on the backside of the textile article are not sheared. Transferring the graphic impression onto the central area having sheared and bushy fibers provides advantages for a Jacquard woven textile, namely the graphic impression is readily accepted by the bushy fibers and the dye or pigment is more uniform in color and appearance and greater detail is possible in the design due to the shortened loops. It also exposes more of the filaments in the sheared yarn or fiber such that it remains soft and water absorbent. The shorter fibers reduce distortion of the graphic impression.

Thus it is apparent that there has been provided, in accordance with the invention, an article and a method of making the article that fully satisfies the objects, aims, and advantages set forth above. While the invention has been described in conjunction with specific embodiments thereof, it is evident that many alternatives, modifications, and variations will be apparent to those skilled in the art in light of the forgoing description. Accordingly, it is intended to enhance all such alternatives, modifications, and variations as fall within the spirit and broad scope of the invention.

What is claimed is:

1. The method of making a printed textile article comprising: providing a two-sided Jacquard woven fibers textile, said textile having a border and a central area within said border, on both sides of said textile, wherein said textile has a dark color border and a light color central area on one side, and a light border and a dark color central area on the other side, and transferring a graphic impression in said central area on said one side on said textile; wherein said border on said one side is capable of masking said graphic impression that may overlap onto said border from said central area on said one side, eliminating the need for precise alignment of said graphic impression within said central area of said one side; and wherein said central area on said other side is capable of masking any potential bleed through of said graphic impression from said central area of said one side.

2. The method of claim 1, wherein said article is a towel.

3. The method of claim 1, wherein said transferring occurs on said central area and on said dark border.

4. The method of making a printed textile article comprising; weaving a two-sided jacquard woven fibers textile article, by weaving a dark border around the entire periphery of said textile on one side and a light color border around the entire periphery on the other side, and weaving a light central area on said one side and a dark central area on said other side within said borders, and transferring a graphic impression in said central area on said one side on said textile wherein said border on said one side is capable of masking said graphic impression that may overlap onto said border from said central area on said one side, eliminating the need for precise alignment of said graphic impression within said central area of said one side; and wherein said central area on said other side is capable of masking any potential bleed through of said graphic impression from said central area of said one side.

5. The method of claim 4, further including the steps of shearing and blooming said textile on at least said one side.

6. The method of claim 4, wherein said transferring occurs on said central area and on said dark border.

7. A method of masking bleed through or misalignment of a printed graphic impression on a woven textile, weaving a two-sided jacquard woven fibers textile article, by weaving a dark border around the entire periphery of said textile on one side and a light color border around the entire periphery on the other side, and weaving a light central area on said one side and a dark central area on said other side within said borders, and transferring a graphic impression in said central area on said one side on said textile, wherein said border on said one side is capable of masking said graphic impression that may overlap onto said border from said central area on said one side, eliminating the need for precise alignment of said graphic impression within said central area of said one side; and wherein said central area on said other side is capable of masking any potential bleed through of said graphic impression from said central area of said one side.

8. The method of claim 7, wherein said article is a towel.

9. The method of claim 7, further including the steps of shearing and blooming said textile on at least said one side.

10. The method of claim 7, wherein said transferring occurs on said central area and on said dark border.

* * * * *